US006902308B2

(12) United States Patent
Love

(10) Patent No.: US 6,902,308 B2
(45) Date of Patent: Jun. 7, 2005

(54) ILLUMINATION SYSTEM

(75) Inventor: David A. Love, Orillia (CA)

(73) Assignee: Rosstech Signals, Inc., Orillia (CA)

( * ) Notice: Subject to any disclaimer, the term of this patent is extended or adjusted under 35 U.S.C. 154(b) by 0 days.

(21) Appl. No.: 10/268,057

(22) Filed: Oct. 9, 2002

(65) Prior Publication Data

US 2003/0076692 A1 Apr. 24, 2003

Related U.S. Application Data

(60) Provisional application No. 60/328,222, filed on Oct. 9, 2001.

(51) Int. Cl.[7] ..... F21V 8/10

(52) U.S. Cl. ..... 362/545; 362/240; 362/800; 362/367; 361/806

(58) Field of Search ..... 362/545, 240, 362/248, 244, 800, 27, 367, 101; 361/806

(56) References Cited

U.S. PATENT DOCUMENTS 5,633,629 A 5/1997 Hochstein ..... 340/907
5,704,708 A * 1/1998 Barson et al. ..... 362/238
6,016,038 A 1/2000 Mueller et al. ..... 315/291
6,150,774 A 11/2000 Mueller et al. ..... 315/291
6,166,496 A 12/2000 Lys et al. ..... 315/316
6,184,628 B1 2/2001 Ruthenberg ..... 315/185 R
6,435,691 B1 8/2002 Macey et al. ..... 362/101
6,474,837 B1 * 11/2002 Belliveau ..... 362/231
6,523,976 B1 * 2/2003 Turnbull et al. ..... 362/231
6,533,445 B1 * 3/2003 Rogers ..... 362/540

* cited by examiner

*Primary Examiner*—Sandra O'Shea
*Assistant Examiner*—Bertrand Zeade
(74) *Attorney, Agent, or Firm*—Harness, Dickey & Pierce, P.L.C.

(57) ABSTRACT

A lighting assembly includes a printed circuit board and a cover. The printed circuit board carries a plurality of groups of LEDs. The cover is unitarily formed and receives the printed circuit board. The cover defines a corresponding plurality of windows. Each of the windows is configured to direct a high intensity light generated by a corresponding one of the groups of LEDs in a distinct direction.

22 Claims, 6 Drawing Sheets

ILLUMINATION SYSTEM

CROSS-REFERENCE TO RELATED APPLICATION

This application claims priority to a provisional patent application which has been assigned U.S. Ser. No. 60/328,222, filed Oct. 9, 2001.

FIELD OF THE INVENTION

The present invention generally pertains to illumination systems. In particular, the present invention pertains to an illumination system including a plurality of pods. More specifically, but without restriction to the particular embodiment and/or use which is shown and described for purposes of illustration, the present invention relates to an illumination system for a spa having a plurality of pods which incorporate a plurality of LEDs.

BACKGROUND OF THE INVENTION

The common method for underwater lighting applications such as spas and hot tubs uses 12-volt incandescent light bulbs encased in molded plastic water-sealed housings. The housings are mounted below the spa water level. This provides an attractive coloured glow to the tubs when in operation. It also provides an added safety measure on tub entry and exit. For mood lighting, manufacturers include snap-on lenses in red and blue tints, for example, to alter the appearance and effect of the spa lighting.

Conventional spa lighting applications such as that described above are associated with specific disadvantages. In this regard, there are some problems with the reliability of such systems. The incandescent bulbs frequently fail during the typical 3-year warrantee period of the tubs. The failure of the 12-volt incandescent light bulbs is primarily due to a couple of factors. These small bulbs are commonly rated for about 1000 hours of operational life. If the lights are in use for only two to three hours per day, the bulb would typically need replacement yearly as a regular spa maintenance procedure. Once initially lighted, the bulb filament is very fragile due to the high temperatures obtained during operation. Even slight jarring or knocking on the bulb housing may dislodge or break the filament, thereby requiring replacement. Also, since incandescent bulbs convert most of their energy to heat and as little as 10% to light, the temperature inside the plastic housing is considerably higher than the ambient air temperature, further reducing the durability of the bulb. Use of incandescent lighting can result in increased manufacturer expense through replacement and occasional on-site warrantee servicing of a failed system.

Exterior, or perimeter lighting installed on hot tubs is increasing in popularity due to its intrinsic decorative appeal, as well as for safety and security illumination. In conjunction with residential exterior lighting and deck lighting systems, illumination of the exterior of a hot tub can add to the ambiance of an outdoor lighting strategy. Hot tubs and spas are commonly used in the evening hours, past sunset. Accessing the hot tub after dark without outdoor illumination in the area can be difficult. Illumination of the hot tub exterior is an additional benefit of a decorative exterior lighting system. Hazards such as obstacles and steps are diffusely illuminated and much more easily navigated with the addition of lighting to the outside of a hot tub.

Adding illumination to the exterior of a spa can also add to security in a residential area. The typically dark area surrounding a hot tub can be illuminated by an act as a form of security lighting. Exterior spa lighting has previously been approached using incandescent and fibreoptic lighting systems, each of which has advantages and disadvantages. While quite fragile and prone to failure as previously described, incandescent perimeter lighting is an inexpensive and simple method for exterior illumination.

Fibreoptic systems can be expensive, but provide adjustable colour variation and an attractive glow. Fibreoptic systems, though, typically use incandescent or halogen bulbs as source lighting, encased in a lighting source housing installed near the controlling spa pack of the hot tub. Fibreoptic wire bundles are grouped and concentrated into an opening in the light housing. The light source is lensed and concerted on the sheared ends of the fibreoptic bundles and the light transmitted to varying locations around the hot tub. However, fibreoptic systems are inefficient from a power consumption standpoint and also contain fragile bulb filaments operating at elevated temperatures. Mechanically these filaments are prone to failure from shock or jarring of the lighting supply housing, or through failure of the lighting supply cooling fan. Fibreoptic lighting systems contain mechanical filtering systems for color changes, typically involving a color wheel incorporating various tinted filters rotating between the light source and the fibreoptic bundle used to transmit the light.

Color changes are gradual and non-uniform throughout the fibreoptic cable termination points, with the result that not all lighting outputs throughout the hot tub change color in unison. A time interval is required for a color transition to occur throughout the lighting array, with different termination points lighting at different stages of a color transition.

A continuous need exists for advancement of the pertinent art.

SUMMARY OF THE INVENTION

It is one object of the present invention to provide a string of multicolour modulating pods containing printed circuit boards with semiconductor LEDs (light emitting diodes).

It is another object of the present invention to provide a perimeter decorative and safety lighting assembly primarily for exterior spas, but which are also useful for outbuildings and decks when encased in a variety of molded plastic housings.

In one form, the present invention provides a lighting assembly including a printed circuit board and a cover. The printed circuit board carries a plurality of groups of LEDs. The cover is unitarily formed and receives the printed circuit board. The cover defines a corresponding plurality of windows. Each of the windows is configured to direct a high intensity light generated by a corresponding one of the groups of LEDs in a distinct direction.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1B:
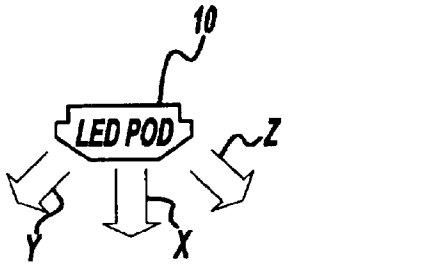
FIG. 1*b* is a simplified view illustrating the direction of light emission from one of the pods of FIG. 1*a*.
Figure 1C:
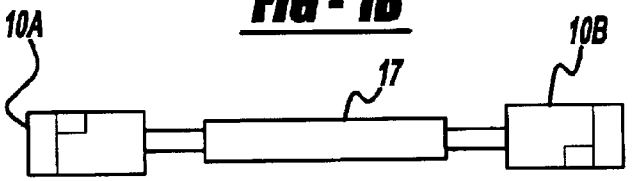
FIG. 1*c* is a simplified view illustrating the interconnection between a master pod and a slave pod.
Figure 1D:
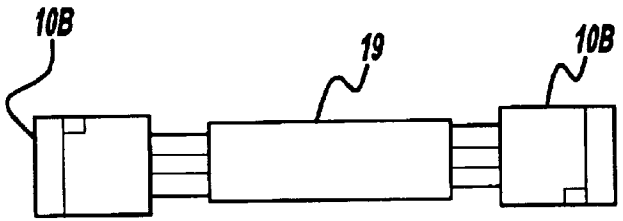
FIG. 1*d* is a simplified view illustrating the interconnection between adjacent slave pods.

The following description of the preferred embodiment(s) is merely exemplary in nature and is in no way intended to limit the invention, its application, or uses.

With initial reference to FIG. 1, a lighting arrangement for a spa constructed in accordance with the teachings of a first preferred embodiment of the present invention is illustrated and generally identified at reference element 2. The lighting arrangement 2 is shown in simplified form mounted to an exemplary spa 4. In the exemplary arrangement illustrated, the spa 4 is an eight foot spa. Once such spa is commercially available from Beachcomber. However, it will become readily apparent to those skilled in the art that the particular spa 4 illustrated in the drawings merely illustrates only an exemplary application. The lighting arrangement 2 of the present invention is equally applicable with other types and sizes of spas.

In the embodiment illustrated, the lighting arrangement 2 of the first preferred embodiment of the present invention is illustrated to include a plurality of pods or lighting pods 10. The plurality of pods is further shown to include one master pod 10*a* and seven slave pods 10*b*. Insofar as the present invention is concerned, the pods 10*a* and 10*b* are otherwise identical in construction and operation.

In the embodiment illustrated, two pods 10 are mounted on each of the four sides of the spa 4. Spacing between adjacent pods 10 on a common side of the spa 4 is approximately 60 horizontal inches. Those skilled in the art will appreciate that the particular number of pods 10 and their specific location on the spa 4 is strictly a matter of design choice. In this regard, any number of pods 10 in various locations on the spa 4 can be incorporated within the scope of the present invention. However, in the application illustrated the installation of two pods 10 per each side of the spa 4 produces an attractive illumination pattern. This will become more apparent below.

Figure 1A:
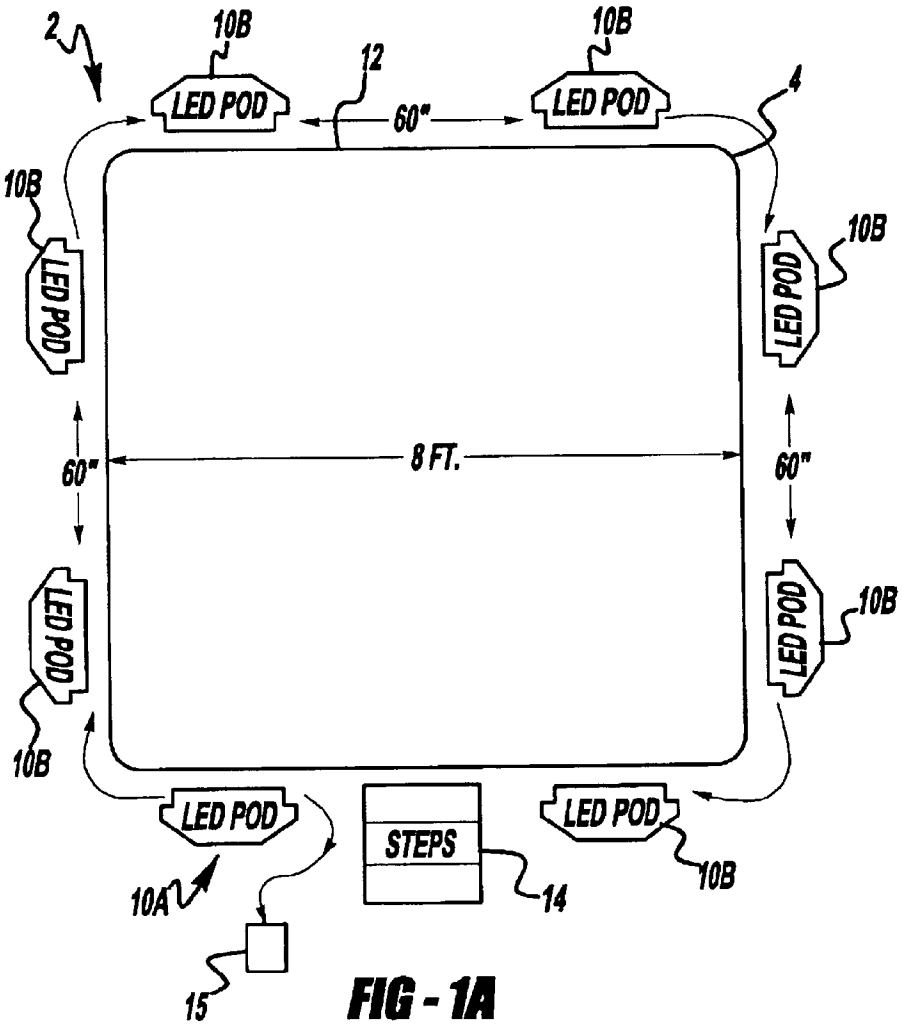
FIG. 1*a* is a simplified schematic view illustrating an exemplary spa incorporating a lighting assembly including a plurality of pods constructed in accordance with the teachings of the present invention.
Figure 2:
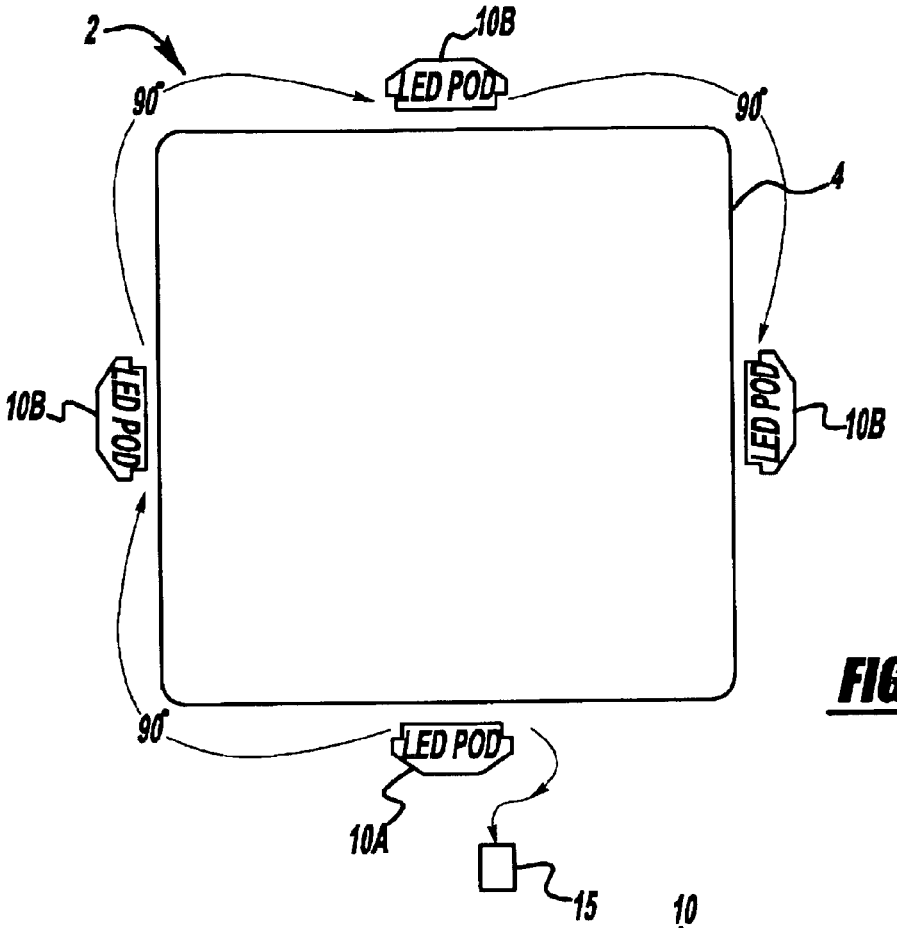
FIG. 2 is another simplified schematic view illustrating the exemplary spa of FIG. 1*a* incorporating an alternate arrangement for a lighting assembly including a plurality of pods constructed in accordance with the teachings of the present invention.

With reference to FIG. 2, an alternate arrangement for the lighting assembly 2 of the present invention is illustrated operatively associated with the spa 4. In this particular arrangement of the lighting assembly 2, a string of four pods 10 (one per side) are provided. The string of four pods 10 includes a single master pod 10*a* and three slave pods 10*b*. This arrangement, in a manner similar to that of FIG. 1, provides excellent ground area illumination and illumination of a step 14 (see FIG. 1*a*) for safety and security.

With continued reference to FIGS. 1*a* and 2, and additional reference to FIGS. 1*b*–1*d* and FIGS. 4–8, the pods 10 of the present invention will be further described. As generally shown in FIG. 1*b*, each of the pods 10 is configured to emit high intensity light in three directions. In a first direction X, the high intensity light is directed in a vertically downward direction. In second and third directions, Y and Z, the high intensity light is directed at angles to the first direction X of approximately 30°. It will be understood that the particular angles of the high intensity light directions X, Y and Z can be varied within the scope of the present invention.

Installing two pods 10 per each side of the spa 4 (as shown in FIG. 1*a*) approximately 0.25 meters from either end produces an attractive illumination pattern as the angled LEDs directed away from the skirt center illuminate the spa skirt vertical edges and define the spa corners. As the LEDs are directed parallel to the skirt face, there is considerable illumination of the ground, or decking area, around the base of the spa 4. This provides an added safety factor, defining the spa location in low ambient light situations, as well as illuminating any steps 14 or obstacles around the spa perimeter in a decorative manner. The arrangement of FIG. 2 also provides an attractive and effective illumination, lighting up a total width at the skirt base of approximately 2.5 meters, typically reaching the skirt edges at the point of intersection with the ground or deck.

In the exemplary arrangements illustrated in FIGS. 1*a* and 2, a first pod of the pluralities of pods is the master pod 10*a*. The master pod 10*a* of each arrangement is connected to a conventional power source 15. As shown in the circuit diagram of FIG. 7, the master pod 10*a* includes the necessary power conversion components and processor integrated circuitry. Adjacent pods 10 are interconnected by four C26 ga PVC jacketed cables 17 and 19 and are mounted to the spa 4 by mounting screws 20 (see FIG. 6) or in another suitable manner well known in the art.

Each pod 10 of the plurality of pods includes a identically configured shell or cover 22. Each cover 22 is integrally formed of plastic or other suitable material. In one particular application, the cover 22 is formed of an ABS plastic. The cover defines three windows 24. Each of the windows 24 is associated with one of the directions X, Y and Z of high intensity light.

Figure 4:
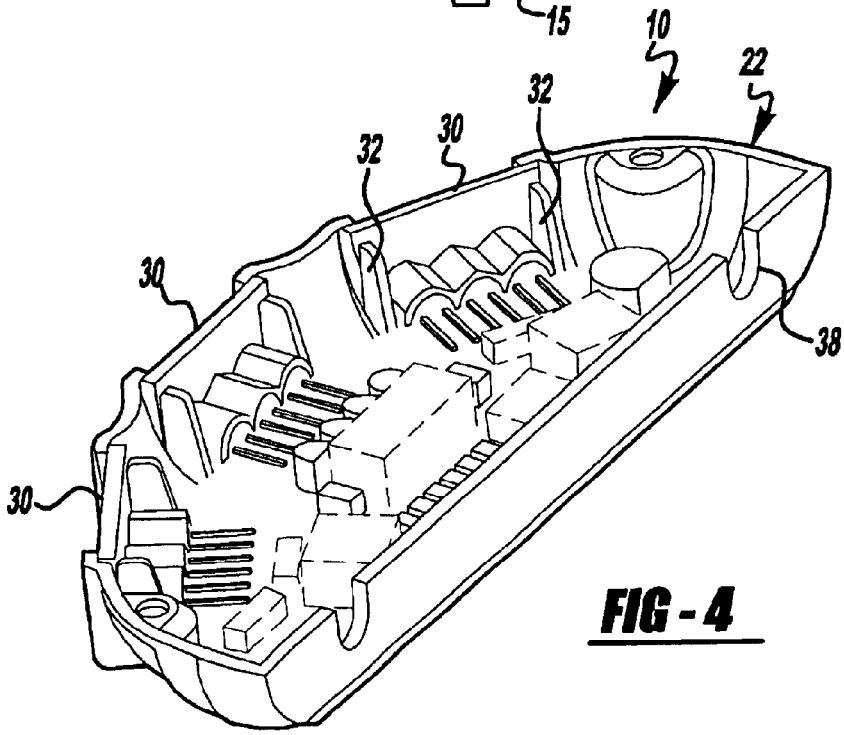
FIG. 4 is an enlarged perspective view illustrating an underside of one of the pods shown in FIGS. 1*a* and 2.
Figure 3C:
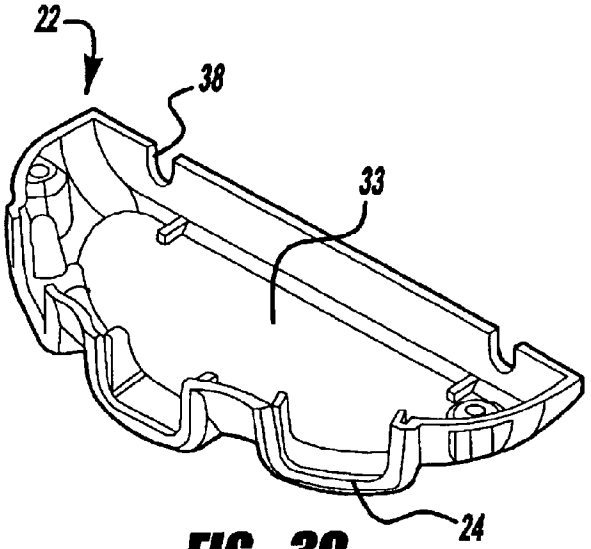
FIGS. 3*a*–3*c* are various views of a top cover for a pod constructed in accordance with the teachings of a preferred embodiment of the present invention.
Figure 3D:
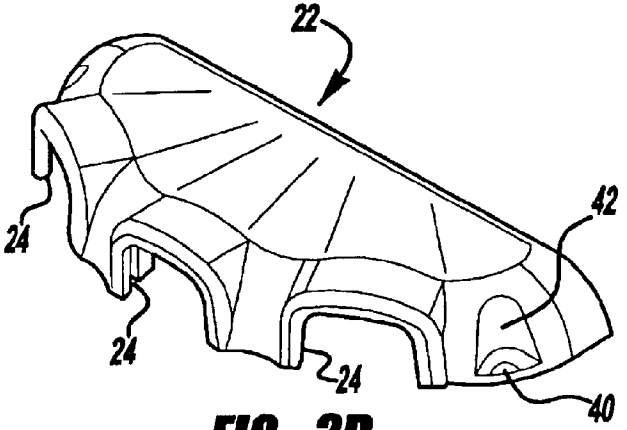
Figure 3A:
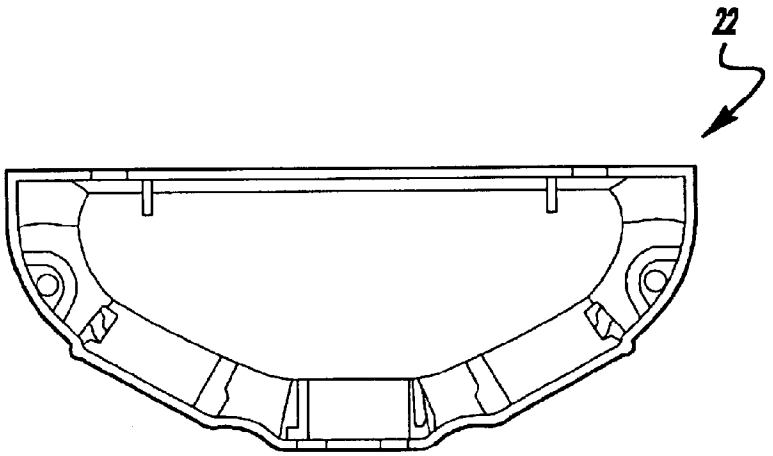
Figure 3B:
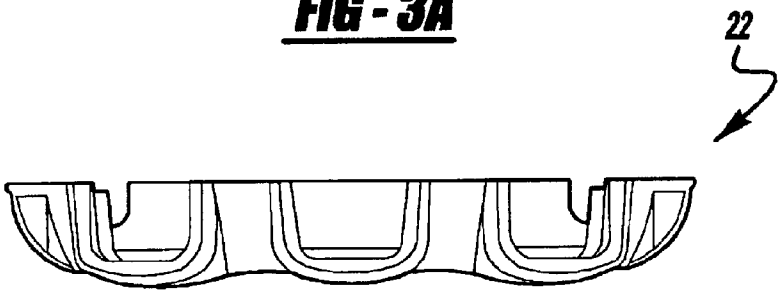
Figure 5:
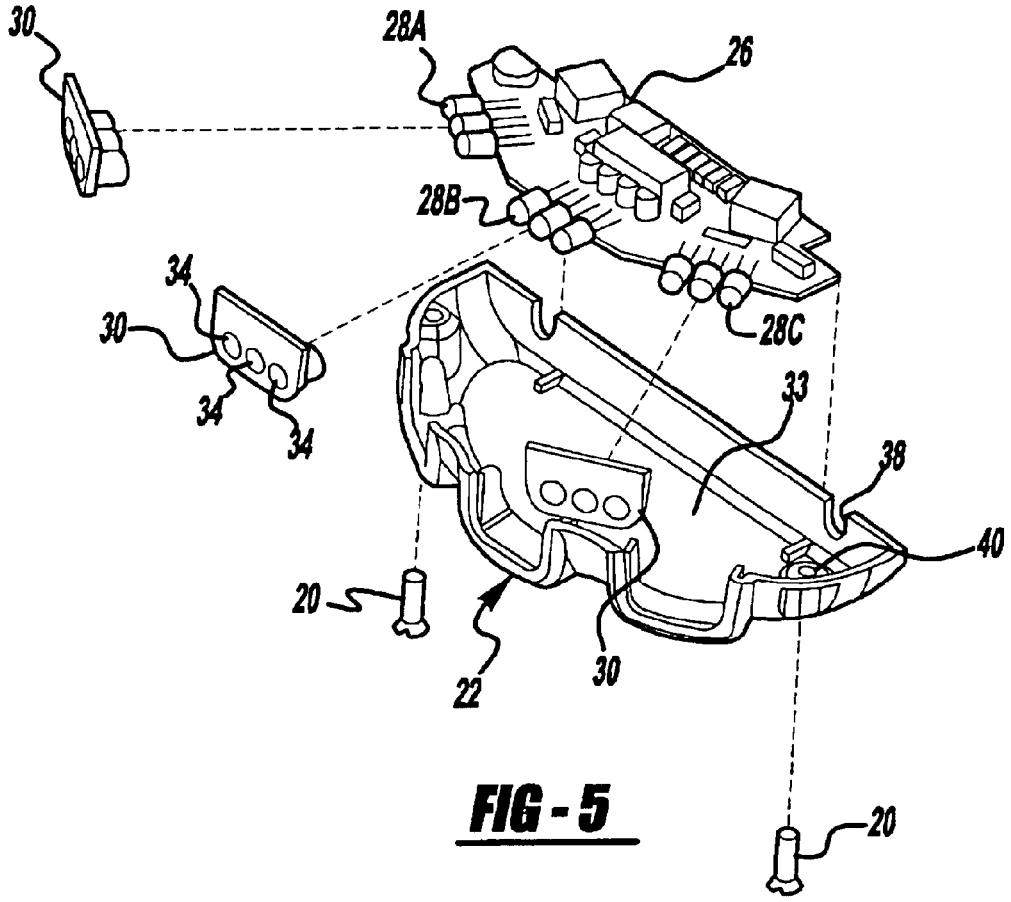
FIG. 5 is an exploded view of the pod of FIG. 4.
Figure 6:
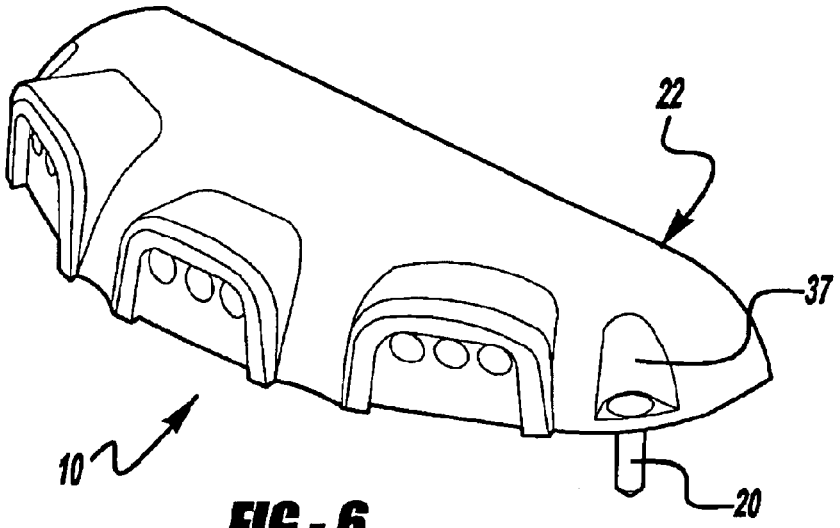
FIG. 6 is an enlarged perspective view of the pod of FIG. 4.

As perhaps shown most clearly in FIGS. 4 and 5, each pod 10 contains a printed circuit board (PCB) 26 having groupings 28A, 28B and 28C of high intensity directional LEDs. Each of the groupings 28A–28C is shown to include 3 LEDs. The LEDs of each grouping 28A–28C have three distinct colours (for example, red, white and blue). The distinct colours are common between the groupings. One LED of each colour is mounted on each of the three frames through LED caps 30. Each LED cap 30 is installed into a gap made by a window frame of the cover 22 and a pair of cap engaging ribs 32 of the cover 22. Each LED cap 30 contains three apertures 34 to be used for a LED grouping 28A–C, which is electrically and physically connected to a printed circuit board (PCB) 26 in a manner well known in the art.

There can be only one defined master board containing the control circuitry and a number of slave boards, this number is dependant on the desired spacing of the pods and the desired length of the illumination area. Each pod 10 contains an integral input and output plug receptacle 38 molded into the pod to allow many slave pods 10*b* to be connected in a string to a single master pod 10*a*. The screw 20 cooperate with mounting holes 40 and countersinks 42 to allow for simple installation. The required wiring lengths can be run along walls, corners, or hidden above soffits, etc.

The pods are intended to be mounted on a horizontal overhang approximately 2–3 cm off vertical walls or lattice work and illuminate the vertical section for a distance of 2–3 m. The LED pods 10 will also provide diffuse illumination of the ground area below the installation for safety and security lighting.

When mounted as intended, one set of LEDs illuminates the face of the vertical structure straight downward in a diffuse cone formed by the LED dispersion angle. One set of LEDs illuminates the vertical structure at an angle 30 degrees from the vertical to one side, the third face illuminating the vertical structure 30 degrees to the other side of the center cone. In this manner, if a single LED colour is selected, this colour will illuminate the vertical surface with three distinct diffuse light cones, the center straight down, the other two at 30 degree angles to either side.

The diffuse illumination cones produced by high intensity LEDs aligned parallel to the illumination surface and elevated by about 1 cm extend for approximately 2 to 3 m linearly in low ambient light conditions, with about a 15 degree conical spread depending on the LED specifications. When used for illumination on the exterior sides (or 'skirt') of an outdoor spa, the spa skirt height is approximately 0.9 m, so the entire height of the skirt is illuminated. The lighting pods 10 are fixed along the top edge of the spa skirt, aligned under the fiberglass tub edge overhang, LED arrays pointing down. On a spa skirt height of 0.9 m, the angled LED light cones traverse d=h/(cos 30), or 1.04 m, and fully illuminate the entire linear section as well, producing an appealing pattern.

Figure 7:
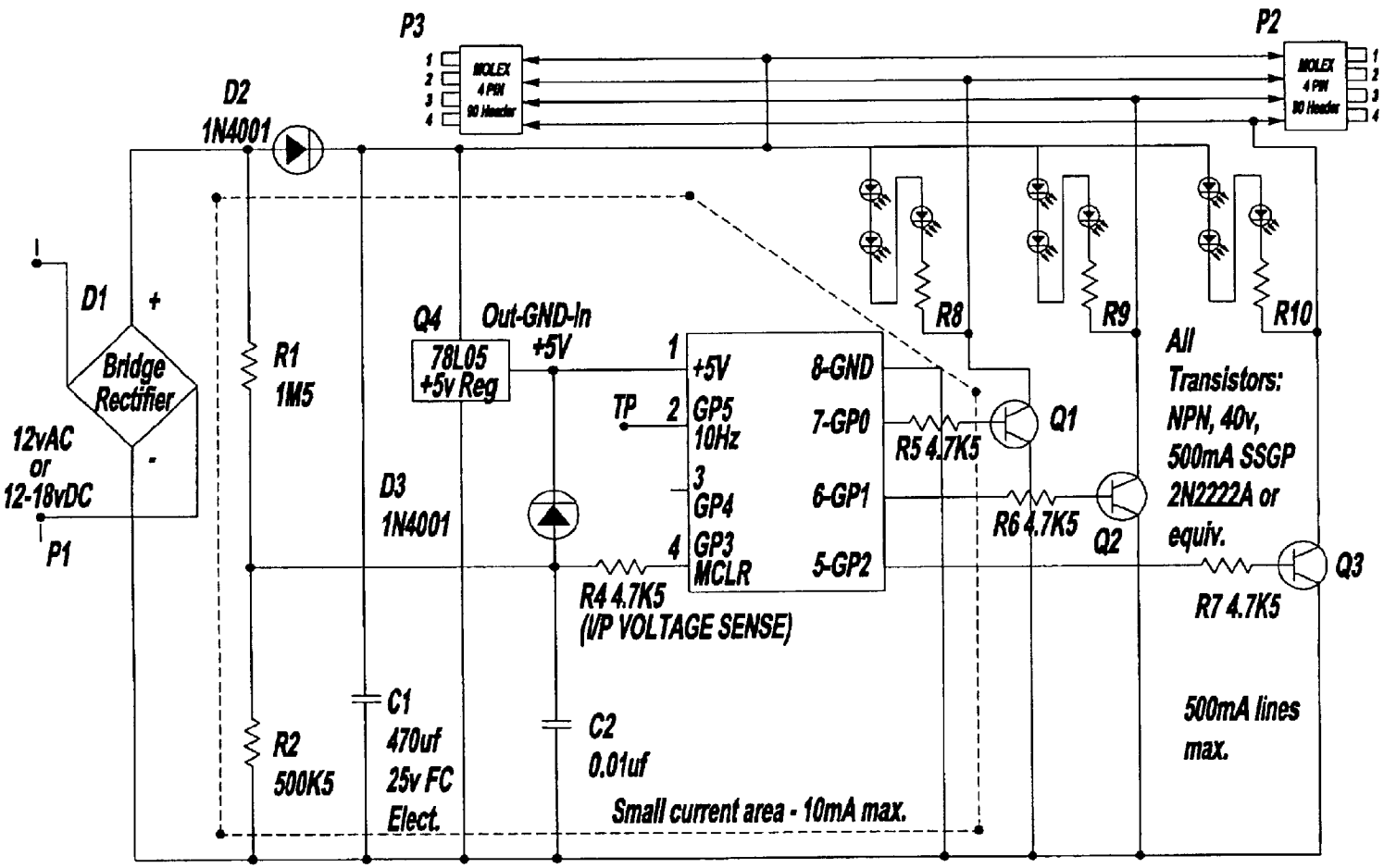
FIG. 7 is a master module circuit diagram for a LED 3 colour sequencer of exterior pod lights.
Figure 8:
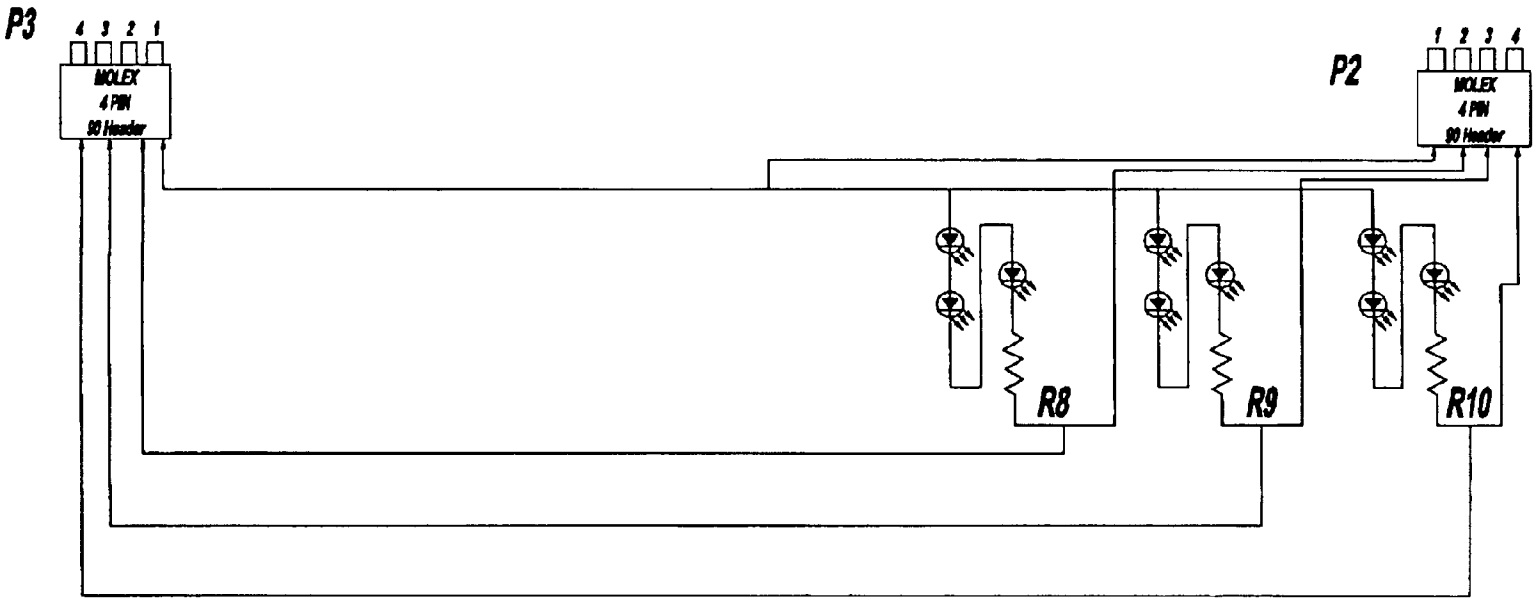
FIG. 8 is a slave module circuit diagram for a LED 3 colour sequencer of exterior pod lights.

With particular regard to FIG. 7, the details of a master module for an LED 3 colour sequencer will be addressed. A microprocessor is installed to control the light timing, modulation feature and colour switching. All pods contain three separate LED arrays, each array consisting of three LEDs and providing a different LED colour. Each LED array includes current limiting resistors R8, R9, and R10 sized to prevent over-current damage to the LED array and to maximize LED luminosity. Resistor sizing is also determined by the power supply provided. As will be appreciated by those skilled in the art, DC and AC power supplies warrant different resistor values. Individual LED current limitations and the application ambient temperature, derating LED luminosity and performance, are also factors incorporated in determining the resistor value.

The power, colour switching and processor activation are controlled from on/off switching of the main power supply P1. An LED arrangement is illustrated incorporating a tri-color LED arrays with a sequencing feature. A bridge rectifier D1 and on-board circuitry converts the standard incoming 12 VAC supply to 18 VDC. This allows for the more flexible options for supplying power to the circuitry. In this configuration the board can be powered by either 12 VAC or 18 VDC. An on-board programmable processors allows independent color switching and color modulation of the LED arrays. The circuitry components allow the IC to retain a time-limited memory (a few seconds) during power off cycles of the main power control switch. In this manner the microprocessor can remember the last illumination colour and switch to the next programmed colour at the re-instatement of power. If the supplied power remains off for a longer period of time, the micro processor loses memory and reverts to its default programming colour for the next power application.

The on-board processor can be used to individually, or simultaneously control any of the LED color arrays. Different LED intensities are controlled by the processor by sending a high or low level signal to the base of the switching transistors (Q1–Q3). Using this control signal, the LEDs can be switched on and off at a frequency higher then eye can perceive. By varying the duty cycle of the waveform, meaning the amount of time the waveform is high (on), compared to the amount of time it is low (off) from the processor, any intensity of the LED can be achieved, from %0–%100.

Using the switching transistors (Q1–Q3) the low voltage control signal can be separated from the higher voltage LED power side of the circuit. Using a preprogrammed computer algorithm, programmed within the processor, an incremented or decremented duty cycle waveform can be achieved, thus resulting in allowing a smooth fade in led intensity. Since these can be controlled individually, one color can be faded up in intensity, and the others down in intensity, thus giving a consistent amount of light intensity at all times, but of differing color. This is essential to the safety aspect of the lights, as there will be no periods of darkness or bright intensities, just differing colors. Through processor programming differing LED colors and arrays can be operated simultaneously, allowing modulation of installed LED colors and the opportunity to blend installed LED colors in various ways to produce secondary and tertiary spectral colors. With careful processor control, essentially a spectral color emission can be achieved through the mixing of two or three base LED colors.

These color variations can be achieved during the transition period of modulating from one LED color to another, or can be set as permanent 'mixed' colors with an independent mode programmed into the processor. Programming of the processor can simply be changed, or updated at a later time to allow for a different modulation effect, or differing set of mixed colors. Programming can also be added to change the overall intensities of the light output, depending upon the customer preference.

The microprocessor is also programmed to operate in a sequencing or modulation mode. When activated, the IC flashes through all available LED colours to indicate it is in modulation mode. The IC then chooses an available LED colour at random and ramps its intensity from 0% to 100% over a predetermined period. The selected colour then remains at 100% intensity for a random period of time, from 3 to 8 seconds. Once this time period has expired, the IC then chooses randomly from the remaining available LED colours and ramps up the new chosen colour while simultaneously ramping down the intensity of the previous colour. It then runs through the cycle again, leaving the chosen colour at 100% intensity for a random period of time, choosing a new colour at random and fading into the new colour after the time period has expired. This serves to create a complete smooth random colour variation and serves as an example of the utility and versatility of the adaptation of LED arrays into exterior spa lighting.

If a lighting string is composed of all master pods with individual control circuitry, the colour modulation and selection will be completely at random for each individual pod, resulting in a multicoloured modulating string when switched to this mode. All single colour selections will match between pods as the processor defaults and colour order progressions are fixed. Further details regarding the control circuitry are provided in common assigned U.S. Ser. No. 09/748,742, which is hereby incorporated by reference as if fully set forth herein.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. For example, while the teachings of the present invention are described primarily in connection with spa applications, other applications are anticipated. In this regard, by a simple modification of the shape and configuration of the printed circuit board (PCB) and the ABS housing shape, the LED board can be mounted under house or garden overhangs to provide decorative and safety lighting to the exterior of a building and the grounds area. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A lighting assembly comprising:

a printed circuit board carrying a plurality of groups of LEDs; and a unitarily formed cover receiving the printed circuit board and defining a corresponding plurality of windows, each of the windows configured to direct a high intensity light generated by a corresponding one of the groups of LEDs in a distinct direction;

wherein the unitarily formed cover includes an open side adapted to be positioned adjacent a generally planer mounting surface.

2. The lighting assembly of claim 1, wherein the plurality of groups of LEDs includes three groups of LEDs.

3. The lighting assembly of claim 1, wherein each group of LEDs includes at least three LEDs having distinct colours.

4. The lighting assembly of claim 3, wherein the distinct colours of the LEDs are common among the three groups of LEDs.

5. The lighting assembly of claim 4, wherein the printed circuit board includes a control arrangement for controlling the groups of LEDs to simultaneously emit a common color.

6. The lighting assembly of claim 3, wherein each group of LEDs is associated with a cap having a three apertures, each aperture receiving one of the LEDs.

7. The lighting assembly of claim 6, wherein each of the caps includes a portion captured between a peripheral frame of the cover and at least one rib defined by the cover.

8. The lighting assembly of claim 3, wherein the distinct colours of the groups of LEDs are independently controllable to adjust intensity.

9. The lighting assembly of claim 5, wherein the control arrangement is operative to simultaneously fade at least a distinct color of each of the groups of LEDs up in intensity and a second distinct color of each of the groups of LEDs down in intensity to continuously provide a constant light intensity of varying colors.

10. The lighting assembly of claim 1, wherein the cover is mounted to a surface illuminated by the lighting assembly.

11. The lighting assembly of claim 10, wherein the groups of LEDs are aligned parallel to the surface illuminated by the lighting assembly.

12. A lighting arrangement comprising:

a plurality of electrically connected lighting pods, each pod including:

a printed circuit board;

a plurality of windows, each window oriented in a different direction; and a plurality of LEDs mounted to the printed circuit board in groups, each group configured to emit high-intensity light through a corresponding one of the windows.

13. The lighting arrangement of claim 12, wherein the LED groups of a pod are oriented to illuminate a surface upon which the pod is mounted.

14. The lighting arrangement of claim 12, wherein the pods comprise:

one or more master pods each having a processor; and one or more slave pods controlled by the one or more processors.

15. The lighting arrangement of claim 12, selectively configurable to be powered by AC or DC power.

16. The lighting arrangement of claim 12, each of the pods further comprising a cover in which the windows are defined and the circuit board is mounted.

17. The lighting arrangement of claim 16, configured to illuminate one or more surfaces, the cover of each of the pods mounted on the one or more surfaces.

18. A lighting arrangement comprising:

a plurality of lighting pods each having a cover by which the pod can be mounted to a surface, each pod having a circuit board mounted inside the cover;

each pod including a plurality of LEDs mounted to the circuit board in groups, each group configured to emit high-intensity light through the cover to illuminate the surface.

19. The lighting arrangement of claim 18, wherein one of the circuit boards comprises a processor configured to modulate the LEDs based on switching of a power supply to the arrangement between on and off states.

20. The lighting arrangement of claim 19, wherein the processor is configured to retain a modulation sequence for the LEDs while the power supply is in an off state.

21. The lighting arrangement of claim 18, wherein each cover comprises a plurality of windows, each window oriented in a different direction.

22. A lighting assembly comprising:

a printed circuit board carrying a plurality of groups of LEDs; and a unitarily formed cover receiving the printed circuit board and defining a corresponding plurality of windows, each of the windows configured to direct a high intensity light generated by a corresponding one of the groups of LEDs in a distinct direction;

wherein each group of LEDs includes at least three LEDs having distinct colours;

wherein each group of LEDs is associated with a cap having three apertures, each aperture receiving one of the LEDs; and wherein each of the caps includes a portion captured between a peripheral frame of the cover and at least one rib defined by the cover.

* * * * *